US005611967A

United States Patent [19]

Jane et al.

[11] Patent Number: 5,611,967

[45] Date of Patent: Mar. 18, 1997

[54] COMBINATION EVAPORATIVE/WARM MIST HUMIDIFIER

[75] Inventors: Rodney Jane, Westboro; John Longan, Shrewsbury, both of Mass.

[73] Assignee: Duracraft Corporatiion, Southborough, Mass.

[21] Appl. No.: 561,089

[22] Filed: Nov. 20, 1995

[51] Int. Cl.[6] ..... B01F 3/04

[52] U.S. Cl. ..... 261/142; 261/23.1; 261/72.1; 261/107; 392/405

[58] Field of Search ..... 261/23.1, 142, 261/72.1, 107; 392/395, 405

[56] References Cited

U.S. PATENT DOCUMENTS

| | | | |
|---|---|---|---|
| 3,873,806 | 3/1975 | Schossow . | |
| 4,003,967 | 1/1977 | Potvin . | |
| 4,089,915 | 5/1978 | Jackson | 392/405 |
| 4,520,864 | 6/1985 | Katagiri et al. . | |
| 4,618,462 | 10/1986 | Fisher | 261/142 |
| 4,752,422 | 6/1988 | Uchida et al. . | |
| 4,752,423 | 6/1988 | Wong . | |
| 4,810,854 | 3/1989 | Jursich et al. . | |
| 4,921,639 | 5/1990 | Chiu . | |
| 5,014,338 | 5/1991 | Glucksman . | |
| 5,034,162 | 7/1991 | Chiu . | |
| 5,067,169 | 11/1991 | Chiu . | |
| 5,111,529 | 5/1992 | Glucksman . | |
| 5,131,070 | 7/1992 | Chiu et al. . | |
| 5,133,044 | 7/1992 | Chiu . | |
| 5,143,460 | 9/1992 | Wang . | |
| 5,143,655 | 9/1992 | Chiu et al. . | |
| 5,143,656 | 9/1992 | Marino et al. . | |
| 5,361,322 | 11/1994 | Glucksman | 261/142 |
| 5,447,663 | 9/1995 | Dix et al. | 261/142 |
| 5,482,657 | 1/1996 | Wright | 261/142 |
| 5,529,726 | 6/1996 | Glenn | 261/142 |

OTHER PUBLICATIONS

1994–1995 Owner's Guide for Holmes HM–3000 Rapid Mist™ Humidifier.

Advertisement for Bionaire Corp.'s W–9 Clear Mist Humidifier, (Publication date not known).

*Primary Examiner*—Tim R. Miles

*Attorney, Agent, or Firm*—Morgan & Finnegan, L.L.P.

[57] ABSTRACT

A combination evaporative/warm mist humidifier comprises a base having an evaporative cavity and a warm mist cavity disposed therein for retaining a liquid. A lower supply portion of a wick element is disposed within the evaporative cavity and an upper evaporative portion is disposed thereabove. The wick element is adapted to provide liquid flow by capillary action from the lower supply portion to the upper evaporative portion. A housing having an evaporative chamber and a warm mist chamber is removably mounted on the base. The evaporative chamber is disposed above the evaporative cavity and is adapted to receive the upper evaporative portion of the wick element. A selectively operable blower assembly is provided in the evaporative chamber for inducing air flow through the upper evaporative portion of the wick element to evaporate liquid content therein and to discharge the evaporated liquid content from the evaporative chamber into the surrounding environment. The warm mist chamber is disposed above the warm mist cavity and a selectively operable heating element is disposed within the warm mist cavity for inducing evaporation of liquid contained therein. The evaporated liquid vapor from the warm mist cavity is introduced into and discharged from the warm mist chamber into the surrounding environment. A switch is provided to selectively energize the blower assembly and/or the heating element so that the humidifier may be operated in an evaporative mode, a warm mist mode, and/or a combined evaporative/warm mist mode.

25 Claims, 12 Drawing Sheets

COMBINATION EVAPORATIVE/WARM MIST HUMIDIFIER

BACKGROUND OF THE INVENTION

1. Field of the Invention

The present invention relates generally to the field of portable electric humidifiers, and more particularly to an improved portable humidifier that is capable of selectively operating in an evaporative and/or warm mist mode.

2. Description of the Related Art

Portable humidifiers are commonly used to enhance environmental conditions in enclosed environments, which might include rooms in residential homes and commercial office buildings. These humidifiers have been found to be very effective in controlling the humidity in these environments during very dry weather and during winter months when low temperature outside air is used to heat the environment causing the relative humidity therein to be lowered to an uncomfortable level.

Various types of portable humidifiers have been used to increase the level of humidity in these environments and may be broken down into the following five broad categories: (1) evaporation type humidifier; (2) steam vaporization type humidifier; (3) warm mist type humidifier; (4) ultrasonic type humidifier; and (5) impeller type humidifier.

A number of well known evaporative humidifiers, such as those disclosed in U.S. Pat. Nos. 5,034,162, 5,143,655 and 5,143,656, employ a wick element or other porous medium which is partly submerged in cold water contained in a reservoir. Liquid flow is produced by capillary action from the reservoir to a non-immersed portion of the wick element disposed in the path of air flow generated by an electric blower. Air moving through the wick element evaporates the water content in the wick element and produces vapor (cool mist) which is dispersed into the surrounding environment to increase the humidification level therein.

Steam vaporization type humidifiers, such as that disclosed in U.S. Pat. No. 4,810,854, typically comprise a water reservoir and an electric heating element submerged in the water to vaporize the water into steam. In this type of device, steam at a temperature of at least 212° F. is discharged directly into the environment to be humidified.

Warm mist type humidifiers have been effectively used to achieve very high humidification levels. Typical warm mist humidifiers are disclosed in U.S. Pat. Nos. 5,014,338, 5,067,169, 5,111,529, 5,131,070, 5,133,044 and 5,143,460, which employ an electric heater coil for converting water contained in a reservoir into steam vapor. The steam vapor rises through a vapor passage and is mixed with air drawn through the passage by an electric blower. The air-vapor mixture (also referred to as "warm mist") is thereafter discharged into the environment to increase the humidification level therein.

While steam vaporization and warm mist type humidifiers both heat the water reservoir to its boiling point, warm mist humidifiers discharge a warm mist (rather than steam) into the environment to be humidified. Because the water reservoir is initially heated to its boiling point, many medical practitioners highly recommend warm mist type humidifiers due to their ability to forestall the growth of micro-organisms in the water reservoir, which otherwise could be subsequently carried by the air stream into the environment and ingested by persons therein.

Ultrasonic type humidifiers, such as those disclosed in U.S. Pat. Nos. 4,752,422, 4,752,423 and 4,921,639, generally comprise a reservoir filled with cool water which is atomized by intense vibration generated by a high frequency ultrasonic transducer. The transducer typically comprises a nebulizer which vibrates quietly at greater than 1½ million times per second in order to convert the water into a fine, cool mist. An air stream created by an electric blower is directed onto the water surface and carries the cool mist out of the humidifier into the environment to be humidified.

Impeller type humidifiers typically employ an upright siphoning tube having a lower end positioned within the water reservoir and an upper end positioned vertically above the water reservoir. The siphoning tube is rotated axially by an electric motor such that water entering an orifice in the lower end of the tube is drawn upwardly through the tube toward its upper end. The siphoned water is then discharged in the form of droplets from the upper end of the rotating tube through a plurality of openings located near the top of the tube. The discharged water is directed against an atomizing screen thereby breaking the discharged water droplets into smaller particles to form a mist. Air being drawn through the humidifier by a fan mixes with the mist and this humidified air is discharged from the humidifier into the surrounding environment.

Presently, there is a tremendous amount of confusion amongst consumers as to whether to purchase a humidifier which discharges a cool mist (such as an evaporative type or impeller type humidifier) or one which discharges a warm mist (such as a warm mist type humidifier). This confusion is accentuated by the fact that medical practitioners and consumers frequently prefer different humidification methods depending upon the reason requiring humidification and even based upon the time of year.

For instance, warm mist humidification is frequently recommended for treating respiratory conditions and/or seasonal afflictions such as rhinitis sicca (commonly referred to as dry nose and/or throat). This preference for warm mist humidification may be predicated, at least in part, upon the soothing effects of the warm mist produced by the warm mist humidifier and/or the ability of warm mist humidifiers to forestall the growth of micro-organisms in the water reservoir by initially bringing the water to a boiling point.

In contrast, however, evaporative type humidifiers producing a cool mist are frequently recommended for daily use in the fall and winter months. This preference for cool mist humidification may be predicated, in part, upon the fact that the cool mist produced by evaporative type humidifiers does not cause an increase in the temperature of the environment to be humidified. Moreover, evaporative type humidifiers may be more energy efficient to operate due to the absence of heating elements and may not increase the evaporation rate of moisture from human skin as a result of elevated room temperatures.

To add to the confusion regarding the benefits of warm mist versus cool mist humidification, several manufacturers have recently marketed evaporative type humidifiers that include an electric heating element for increasing the moisture output. These modified evaporative type humidifiers employ an electric heater to elevate the water temperature in the reservoir and/or an electric heater to elevate the temperature of the air being drawn into the humidifier. However, in contrast to true warm mist humidifiers, these modified evaporative type humidifiers only utilize wick filters and do not elevate the temperature of the water in the reservoir to a boiling point, thereby forestalling the growth of micro-organisms therein.

SUMMARY OF THE INVENTION

The present invention overcomes the difficulties associated in selecting the most appropriate humidifier for the particular application by providing a single, improved portable humidifier that is capable of selectively being operated in an evaporative (cool mist) mode, a warm mist mode, and/or a combination evaporative and warm mist mode.

The combination evaporative/warm mist humidifier according to the present invention comprises a base having an evaporative cavity and a warm mist cavity disposed therein for retaining a liquid. A lower supply portion of a wick element is disposed within the evaporative cavity and an upper evaporative portion is disposed thereabove. The wick element is adapted to provide liquid flow by capillary action from the lower supply portion to the upper evaporative portion. A housing having an evaporative chamber and a warm mist chamber is removably mounted on the base. The evaporative chamber is disposed above the evaporative cavity and is adapted to receive the upper evaporative portion of the wick element. A selectively operable blower assembly is provided in the evaporative chamber for inducing air flow through the upper evaporative portion of the wick element to evaporate liquid content therein and to discharge the evaporated liquid content from the evaporative chamber into the surrounding environment. The warm mist chamber is disposed above the warm mist cavity and a selectively operable heating element is disposed within the warm mist cavity for inducing evaporation of liquid contained therein. The evaporated liquid vapor from the warm mist cavity is introduced into and discharged from the warm mist chamber into the surrounding environment. A switch is provided to selectively energize the blower assembly and/or the heating element so that the humidifier may be operated in an evaporative mode, a warm mist mode, and/or a combined evaporative/warm mist mode.

The foregoing specific objects and advantages of the invention are illustrative of those which can be achieved by the present invention and are not intended to be exhaustive or limiting of the possible advantages which can be realized. Thus, this and other objects and advantages of this invention will be apparent from the description herein or can be learned from practicing this invention, both as embodied herein or as modified in view of any variations which may be apparent to those skilled in the art. Accordingly, the present invention resides in the novel parts, constructions, arrangements, combinations and improvements herein shown and described.

BRIEF DESCRIPTION OF THE DRAWINGS

The foregoing features and other aspects of the invention are explained in the following description taken in connection with the accompanying drawings wherein.

DESCRIPTION OF THE PREFERRED EMBODIMENTS

Figure 1:
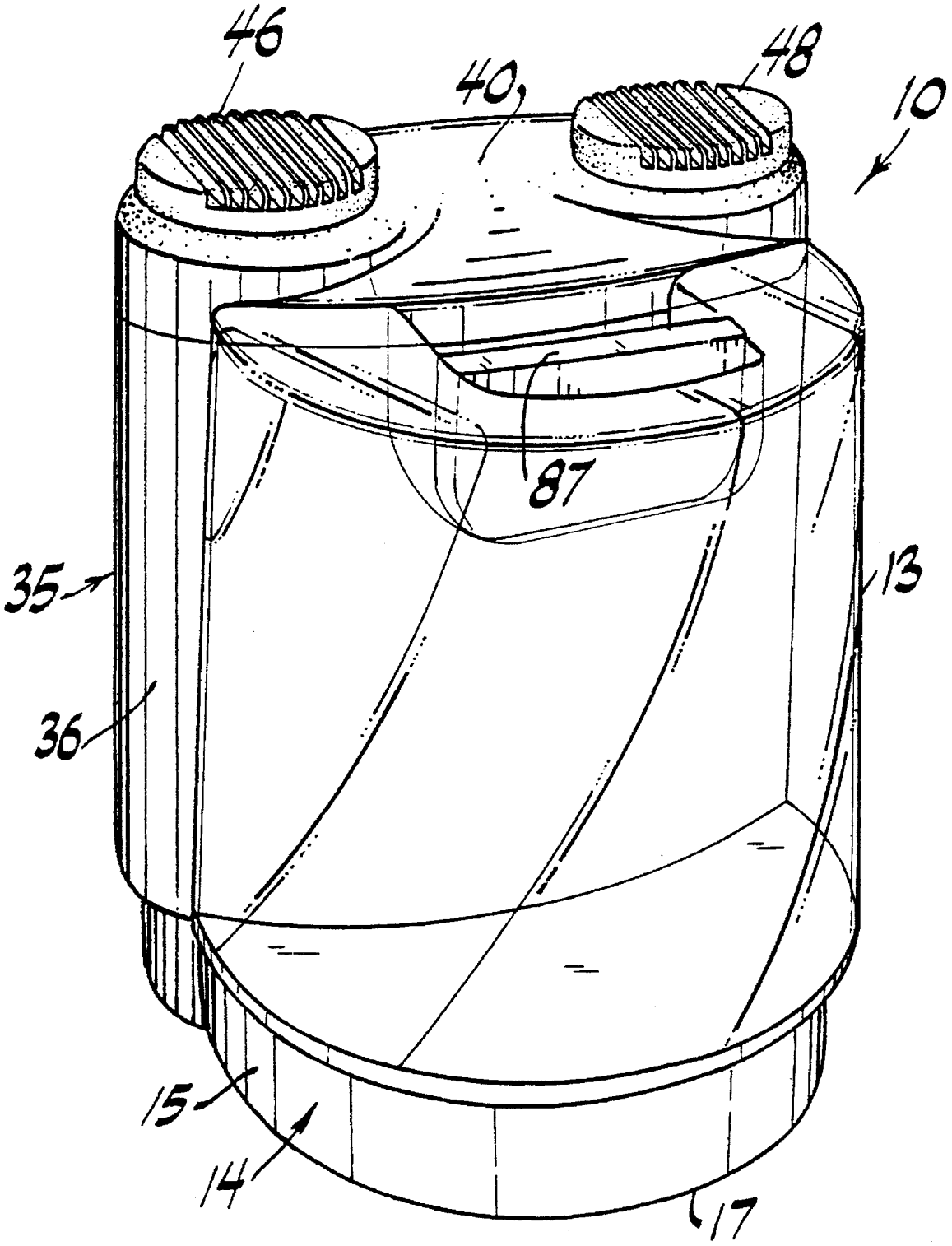
FIG. 1 is a perspective view of the combination evaporative/warm mist humidifier of the present invention.
Figure 2:
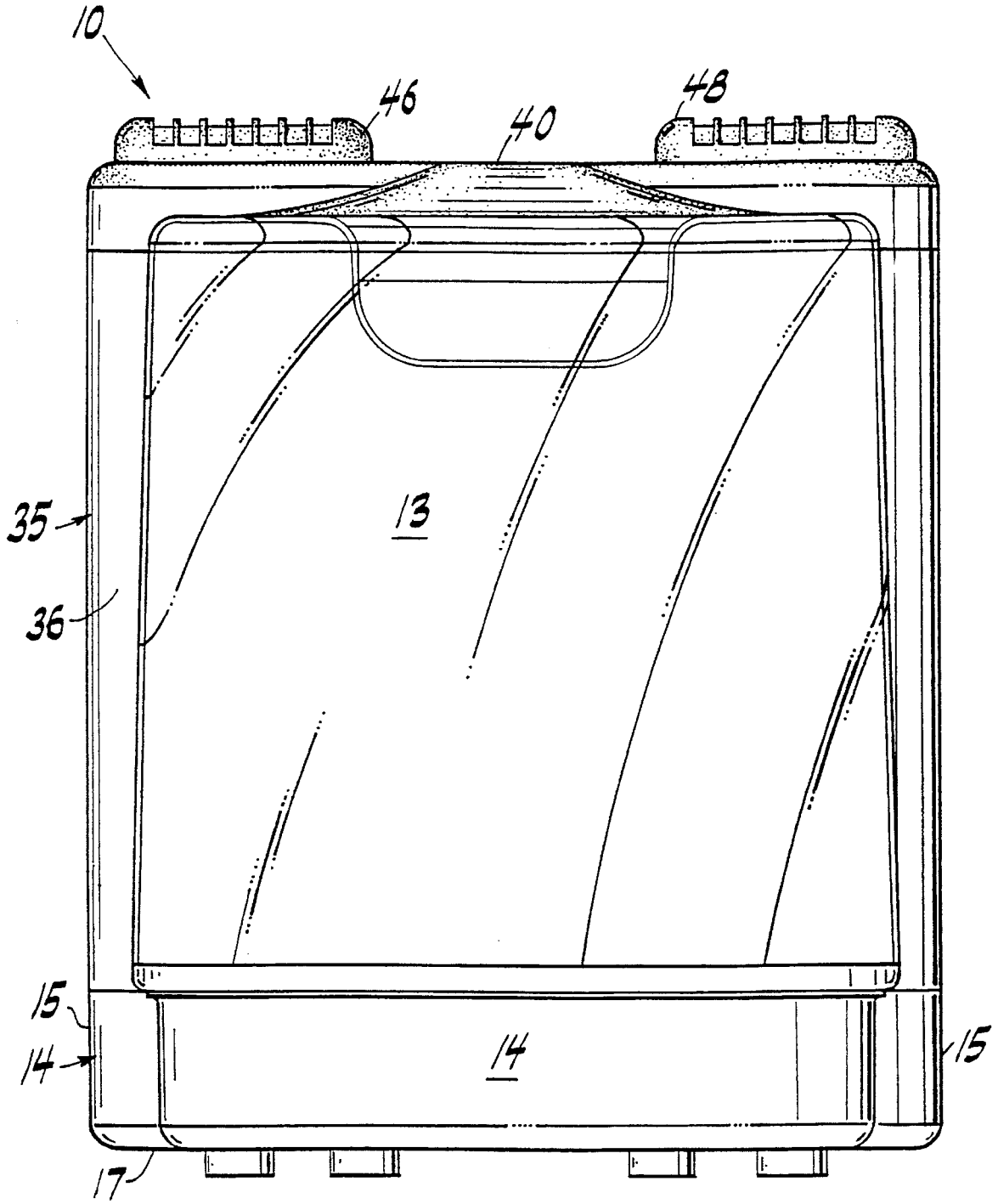
FIG. 2 is a front elevational view of the humidifier illustrated in FIG. 1.
Figure 3:
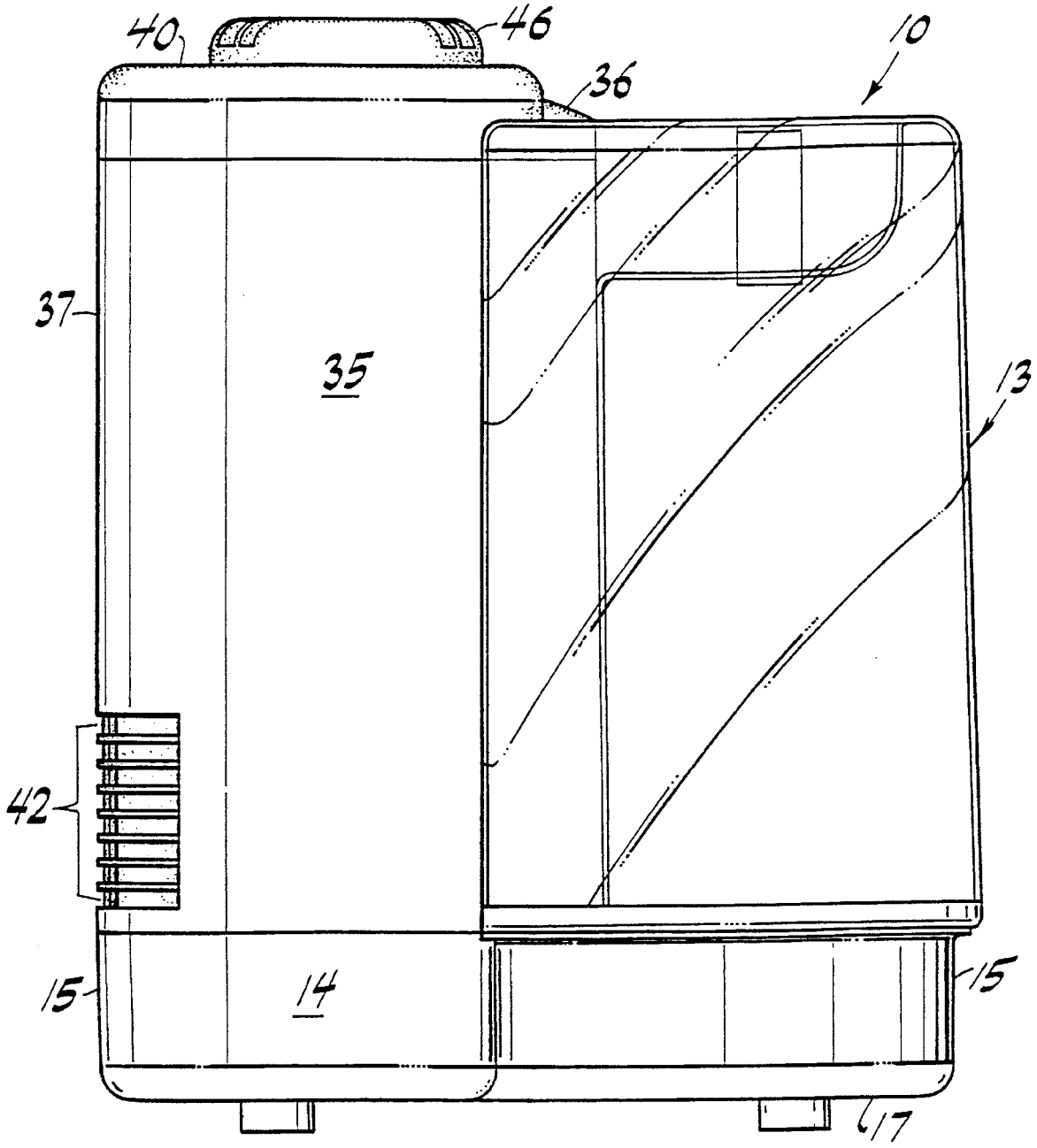
FIG. 3 is a left side elevational view of the humidifier illustrated in FIG. 1.
Figure 4:
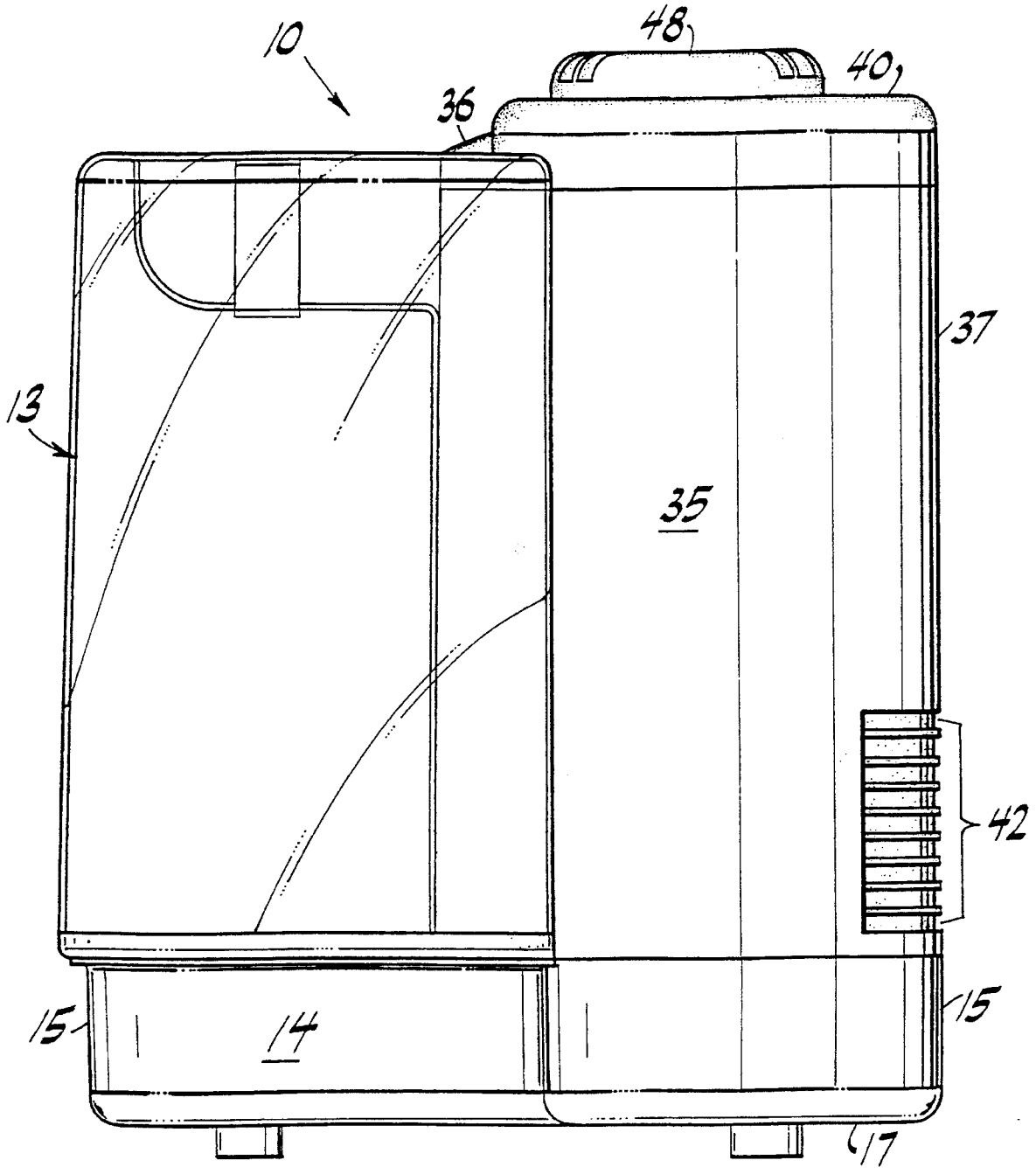
FIG. 4 is a right side elevational view of the humidifier illustrated in FIG. 1.
Figure 5:
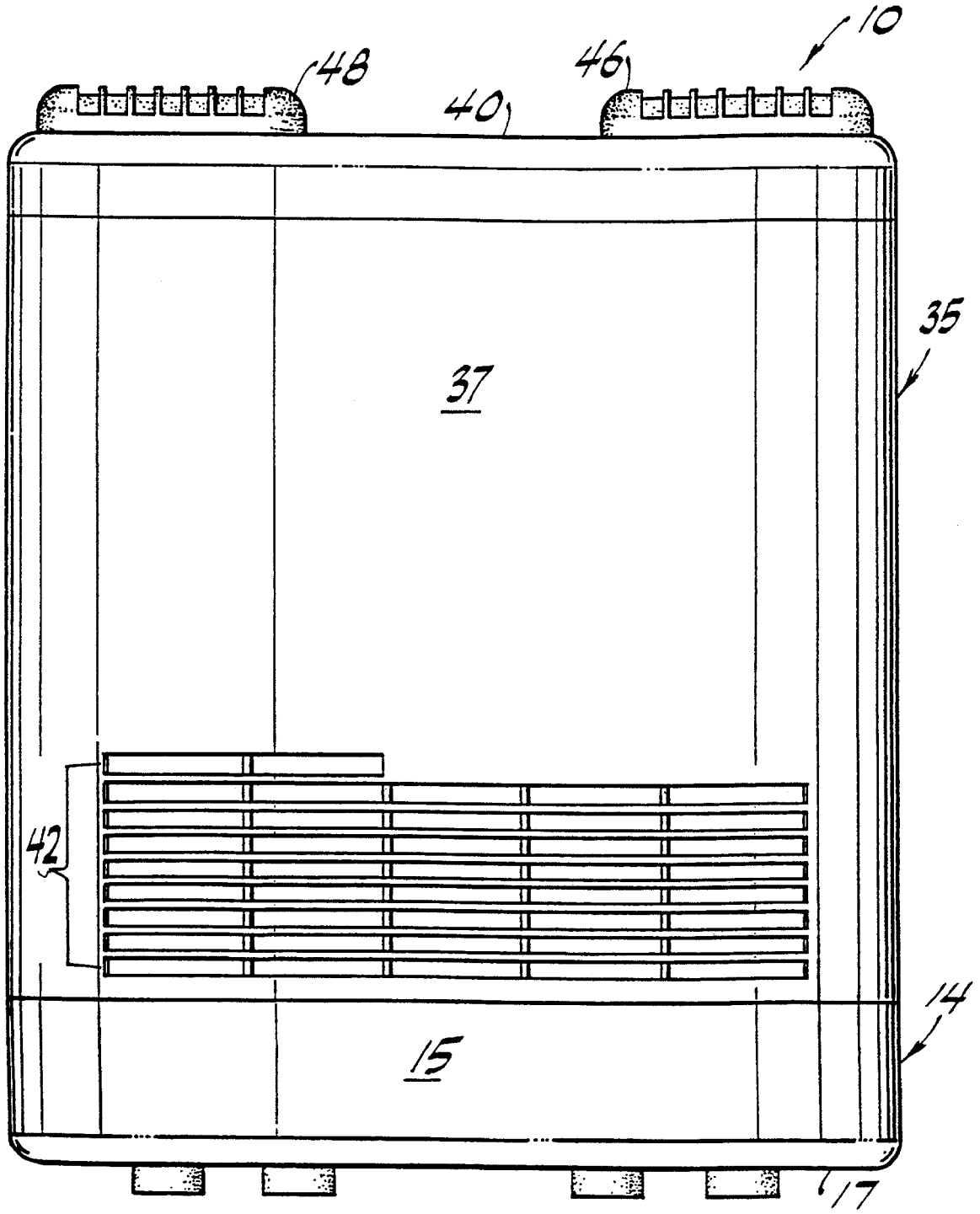
FIG. 5 is a rear elevational view of the humidifier illustrated in FIG. 1.
Figure 6:
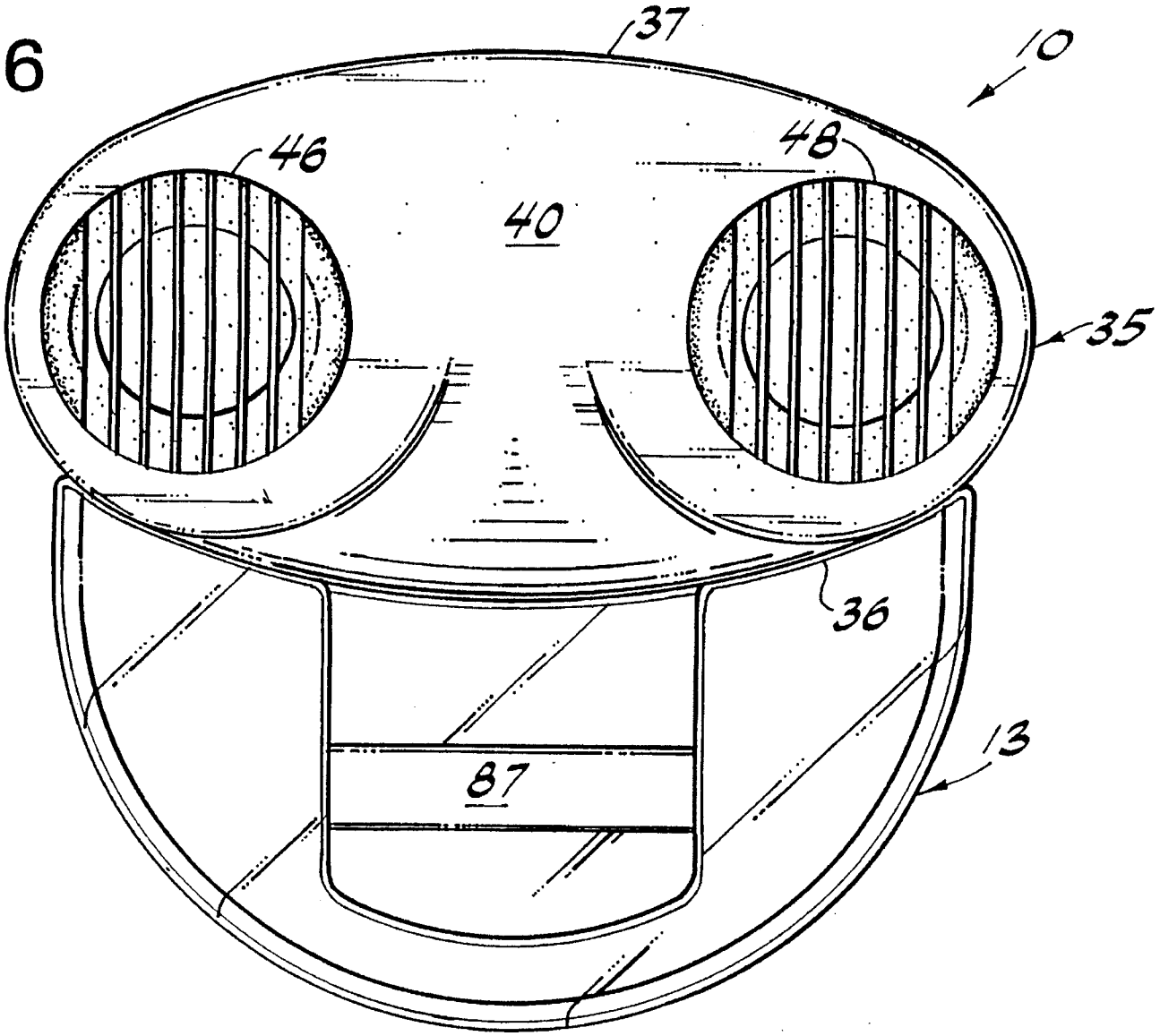
FIG. 6 is a top plan view of the humidifier illustrated in FIG. 1.
Figure 7:
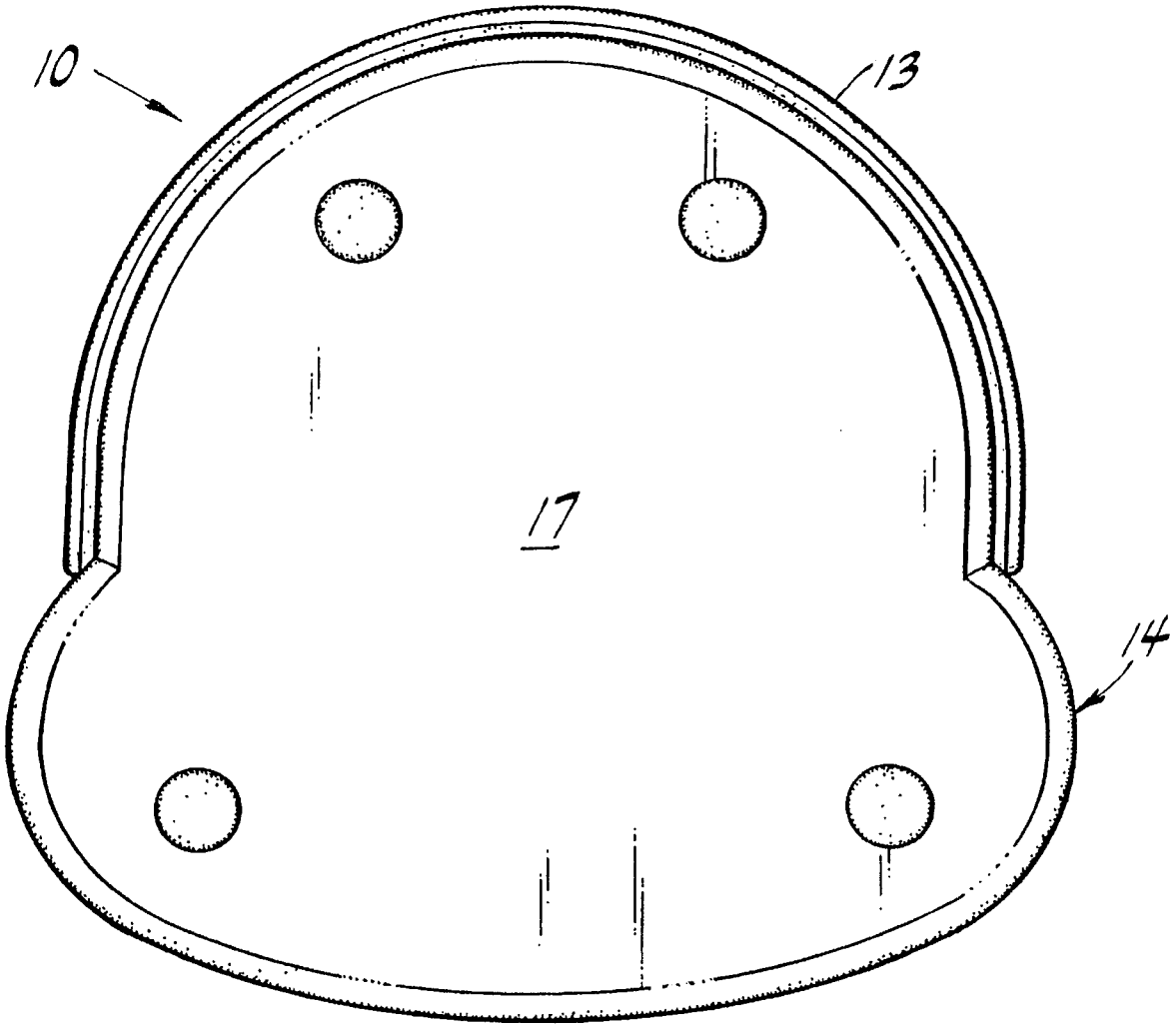
FIG. 7 is a bottom plan view of the humidifier illustrated in FIG. 1.

Referring to the drawings, the humidifier 10 according to a preferred embodiment of the present invention comprises a housing 35, a liquid supply tank 13 and a base 14, each of which is preferably made from plastic or other suitable materials. A peripheral wall 15 extends upwardly from a lower surface 17 of the base 14 and extends continuously along the perimeter of the base 14. The housing 35 and liquid supply tank 13 are each removably mounted above the lower surface 17 of the base 14 and are both supported by the peripheral wall 15.

Figure 9:
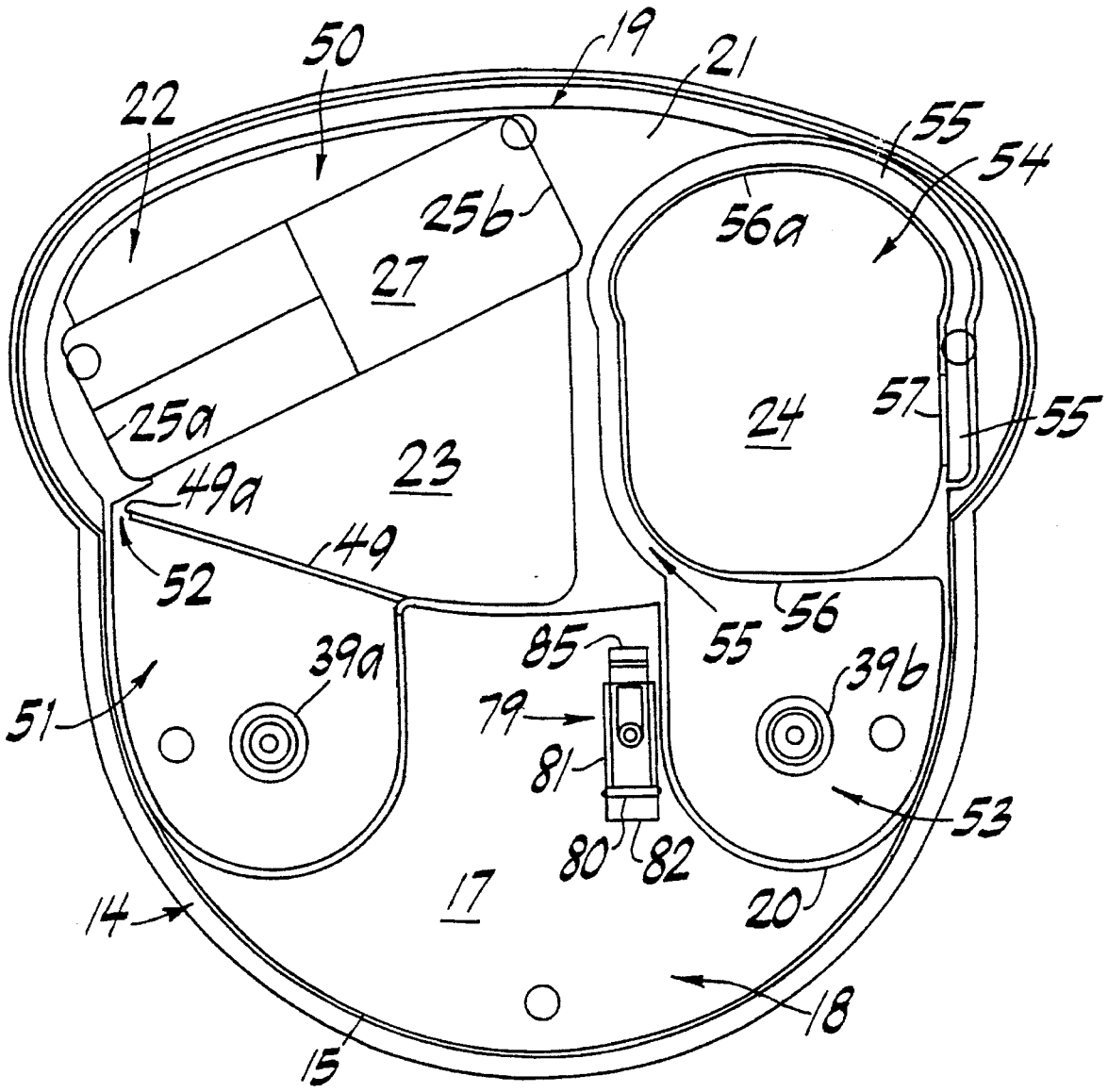
FIG. 9 is a top plan view illustrating the base and removable tray of the humidifier shown in FIG. 1.
Figure 10:
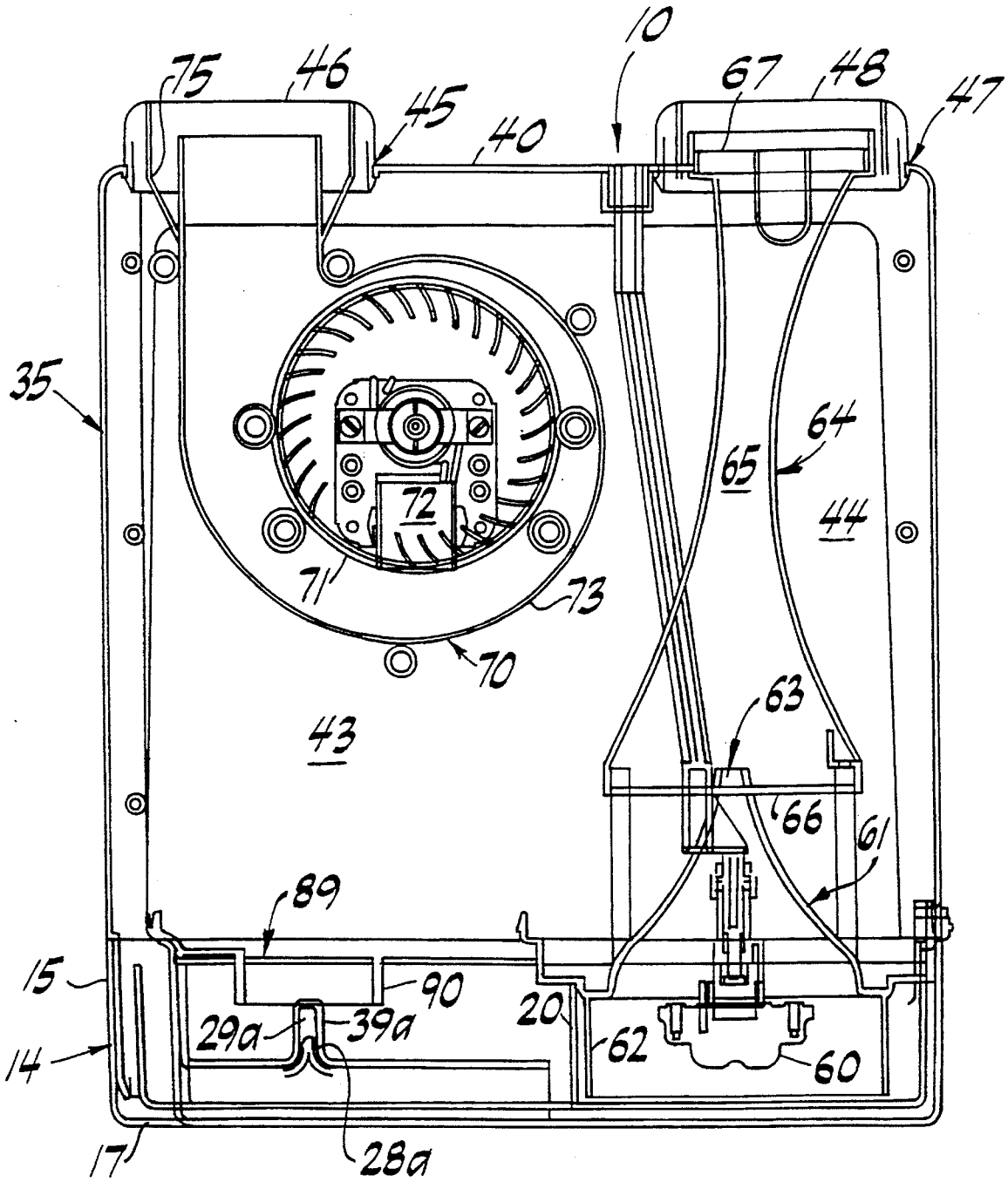
FIG. 10 is a cross sectional view of the front of the humidifier illustrated in FIG. 1.

As best illustrated in FIG. 9, the peripheral wall 15 and the lower surface 17 of the base 14 define a recess 18. A removable tray 19, preferably having a shape which conforms generally to that of the peripheral wall 15, is positioned in the recess 18 and supported by the lower surface 17 of the base 14. Projecting upwardly from the bottom surface 22 of the tray 19 are valve actuator stems **39*a* and 39*b*, the purpose of which will be described hereinafter. As illustrated in FIG. 10, a locating hole 29*a*, 29*b* is preferably formed on the underside of the bottom surface 22 of tray 19 directly beneath a respective stem 39*a*, 39*b*. Locating pins 28*a* and 28*b* project upwardly from the lower surface 17 of the base 14 and are received within locating holes 29*a* and 29*b* respectively to assure that the tray 19 is positioned and retained in its proper location relative the base 14**.

As illustrated in FIG. 10, the removable tray 19 also comprises a peripheral skirt 20 extending upwardly from the bottom surface 22 around the periphery of the tray 19. The height of skirt 20 is slightly less than the height of the peripheral wall 15. A dividing wall 21 (which is preferably formed integrally with the peripheral skirt 20) separates the interior of the tray 19 into evaporative and warm mist cavities 23 and 24, respectively.

Figure 8:
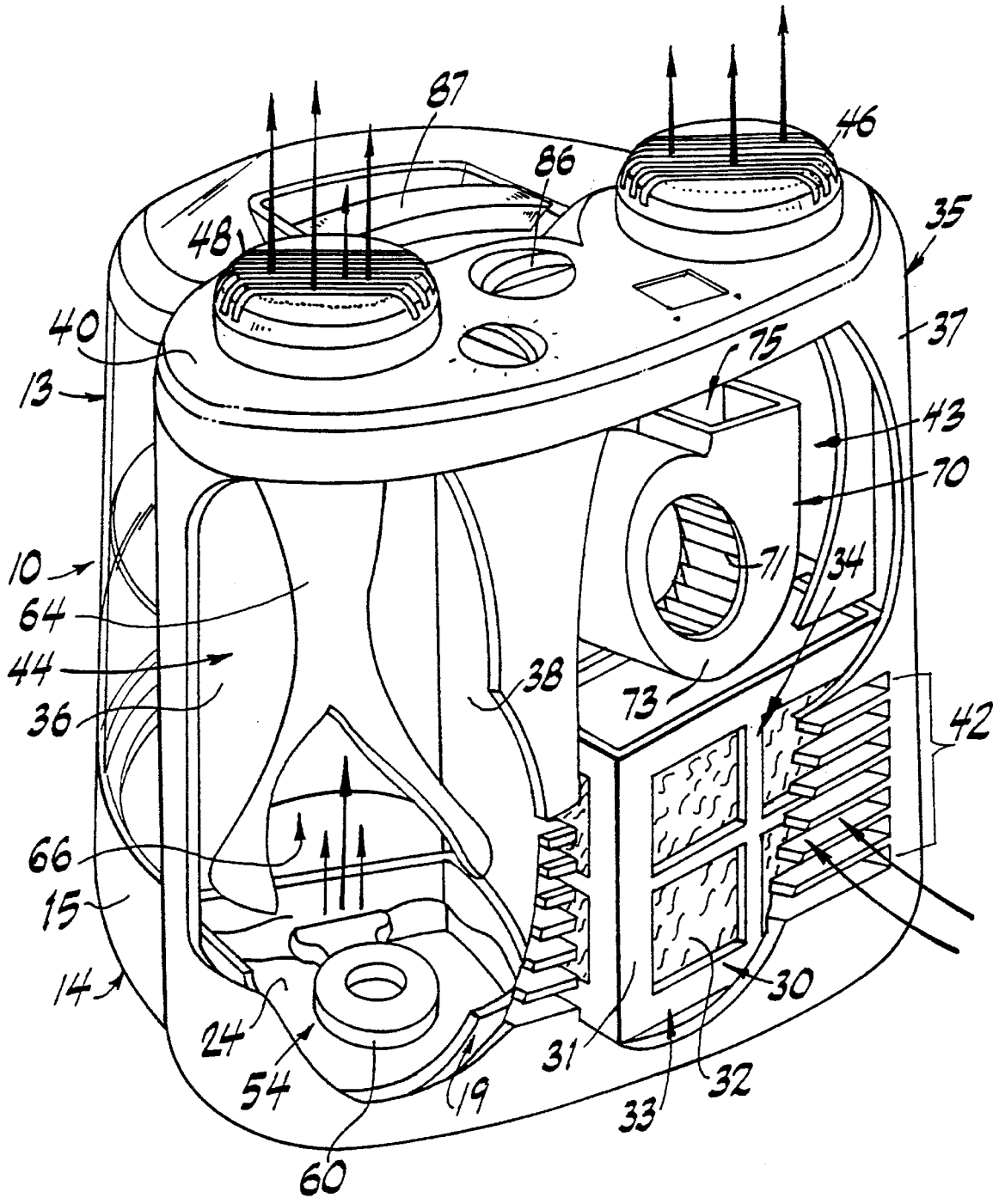
FIG. 8 is a rear perspective view partially in cross section illustrating the operation of the humidifier shown in FIG. 1.

The peripheral skirt 20 proximate the evaporative cavity 23 includes two generally opposed, parallel notches **25*a*, 25*b* which are joined together by channel 27 formed in the bottom surface 22 of the tray 19. As illustrated in FIG. 8, a wick element 30, comprising a lower supply portion 33 and an upper evaporative portion 34, includes a framework 31 forming a plurality of compartments each filled with a suitable absorbent capillary wick material 32. Part of the framework 31 associated with the lower supply portion 33 of the wick element 30 is received within the channel 27 and notches 25*a*, 25*b*. Accordingly, the lower supply portion 33 of the wick element 30 is retained within the evaporative cavity 23 and the upper evaporative supply portion 34 of the wick element 30 is disposed above the evaporative cavity 23**.

Referring to FIG. 9, the evaporative cavity 23 is divided into an evaporative portion 50 and a reservoir portion 51 by a dividing wall 49 projecting into the evaporative cavity 23 from the peripheral skirt 20. The terminal end 49*a* of the dividing wall 49 terminates within the evaporative cavity 23 proximate, but before, an opposed portion of the skirt 20 and defines a liquid supply channel 52 connecting the reservoir portion 51 with the evaporative portion 50.

The warm mist cavity 24 formed in tray 19 includes a reservoir portion 53 and a boiler cavity 54. A liquid supply channel 55, which is formed by a boiler cavity wall 56 extending around the periphery of the boiler cavity 54, fluidly connects the reservoir portion 53 with the boiler cavity 54 through an orifice 57 formed in the boiler cavity wall 56. A portion 56*a* of the boiler cavity wall 56 is of reduced height relative the height of the liquid supply channel 55.

Because of the high temperatures which may be produced in the boiler cavity 54 during operation of the humidifier 10, an insulating material may be preferably provided beneath the boiler cavity 54 of tray 19. In a preferred embodiment, a cavity is provided in the base 14 directly beneath the boiler cavity 54 in which an insulating material is inserted. In this manner, a person coming in contact with the underside of the base 14 may be protected from the heat generated in the boiler cavity 54.

The valve actuator stem 39*a* and associated locating hole 29*a* are formed in the reservoir portion 51. The valve actuator stem 39*b* and associated locating hole 29*b* are formed in the reservoir portion 53.

In the preferred embodiment, the upright housing 35 is cylindrically shaped and is formed by curved front and rear walls 36 and 37 which may be joined together or integrally formed with one another. It is recognized, however, that other geometric shapes (e.g., square, rectangular, semi-circular, round, etc.) may be utilized for shape of the housing 35, as well as the base 14 and tray 19, without departing from the spirit and/or scope of the invention. One end of the upright housing 35 is enclosed by a top portion 40 positioned above and secured to the front and rear walls 36, 37. The opposite end or bottom portion 41 of the housing 35 is open and is supported above the evaporative and warm mist cavities 23, 24 by the peripheral wall 15 of base 14.

Figure 11:
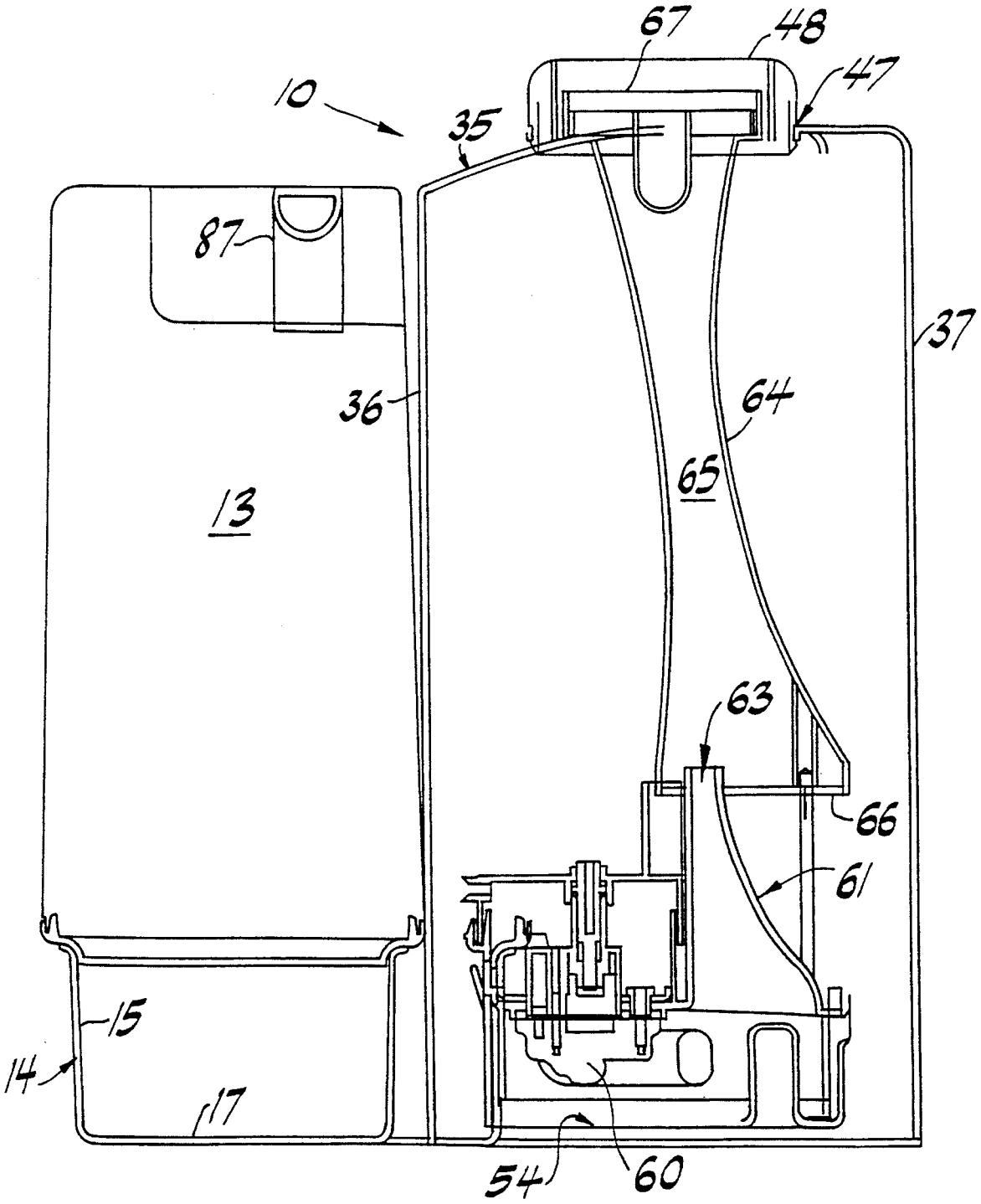
FIG. 11 is a cross sectional view of the right side of the humidifier illustrated in FIG. 1.
Figure 12:
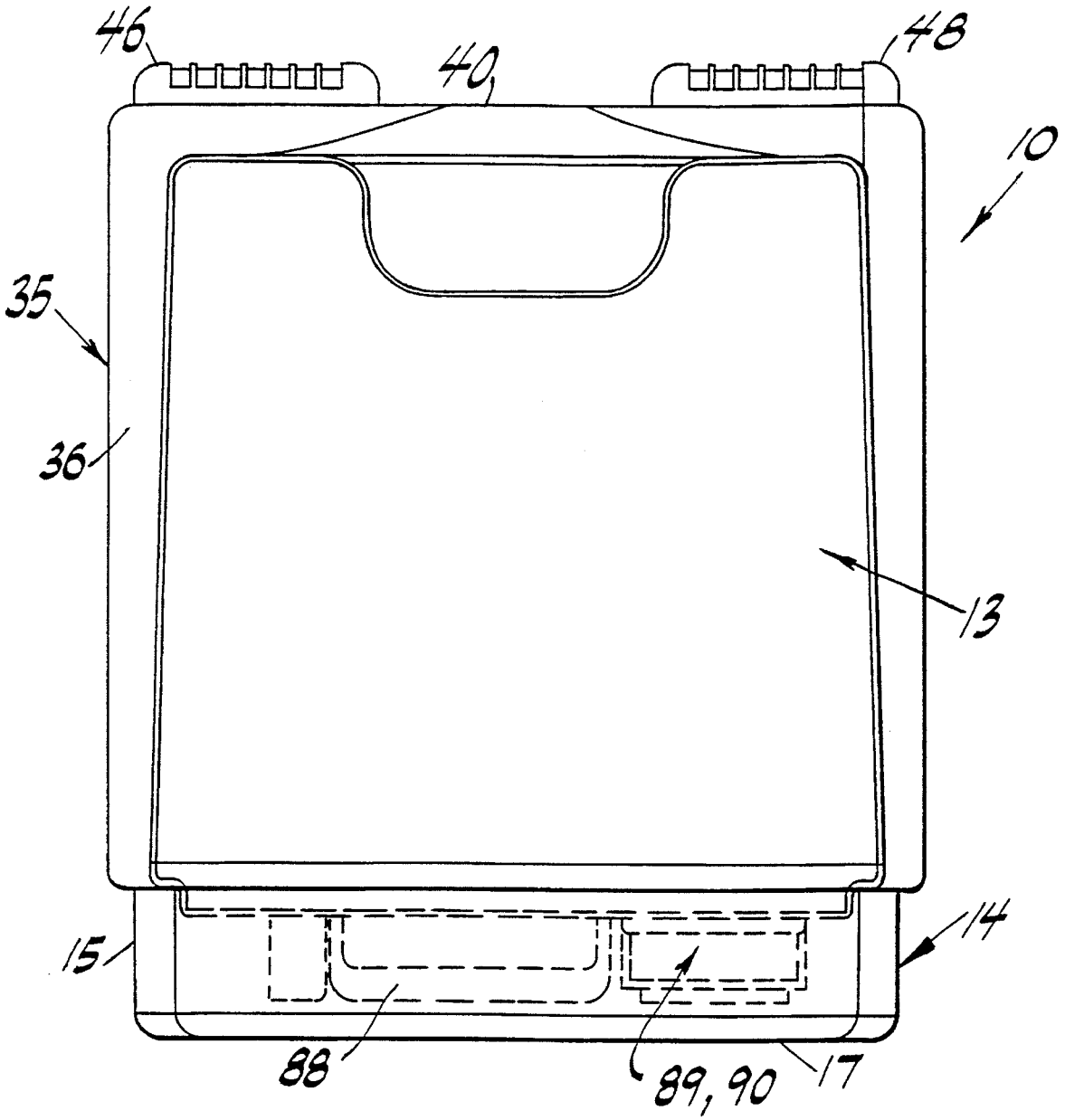
FIG. 12 is a front elevational view illustrating the lower handle on the liquid supply tank of the humidifier shown in FIG. 1.

As best illustrated in FIGS. 8 and 10–11, the interior of the upright housing 35 (formed by the top portion 40 and front and rear walls 36, 37) is open. A dividing wall 38, extending inwardly from the front and rear walls 36, 37, separates the interior of the housing 35 into evaporative and warm mist chambers 43 and 44, respectively.

A plurality of inlet slots 42 formed in a lower portion of the rear wall 37 of the housing 35 provide an inlet opening into the evaporative and warm mist chambers 43 and 44. An evaporative discharge opening 45 is formed in the top portion 40 above the evaporative chamber 43 to provide a discharge opening from the evaporative chamber 43. A warm mist discharge opening 47 is formed in the top portion 40 above the warm mist chamber 44 to provide a discharge opening from the warm mist chamber 44.

As illustrated in FIGS. 10 and 11, the warm mist chamber 44 proximate the bottom portion 41 of the housing 35 is preferably enclosed by a plastic shroud 61, which may be fastened to the housing 35. A continuous flange 62, having a shape corresponding to that of the boiler cavity 54, extends downwardly from the shroud 61 so that the flange may be received within the boiler cavity 54. Projecting downwardly from the shroud 61 and surrounded by the continuous flange 62 is a humidification producing heater coil 60 (preferably of the electric type) which projects downwardly into the boiler cavity 54 of the tray 19.

Formed within the plastic shroud 61 above the heater coil 60 and extending into the warm mist chamber 44 is an opening 63, which is preferably in the shape of an inverted funnel having a larger area proximate the heater coil and gradually reducing in area as the opening 43 extends into the warm mist chamber 44.

Mounted to the housing 35 within the warm mist chamber 44 directly above the opening 63 is a vapor discharge tube 64, which is illustrated in FIGS. 8 and 10–11 and is preferably made of plastic material. The vapor discharge tube 64 has an vapor passageway 65 extending therethrough from an inlet end 66 proximate the opening 63 in shroud 61 to a discharge end 67 proximate the warm mist discharge opening 47 formed in the top portion 40 of housing 35.

The inlet end 66 of the vapor discharge tube 64 is positioned within the warm mist chamber 44 proximate the inlet slots 42 formed in the rear wall 37 of housing 35. A portion of the opening 63 in shroud 61 extends partially into the inlet end 66 of the vapor discharge tube 64. The vapor passageway 65 at the inlet end 66 of the vapor discharge tube 64 is preferably formed in the shape of an inverted funnel so that ambient air drawn through inlet slots 42 may be mixed with steam vapor drawn through opening 63 in shroud 61 and carried through the vapor passageway 65.

The vapor passageway 65 at the discharge end 67 of the vapor discharge tube 64 is preferably funnel-shaped and projects slightly through the warm mist discharge opening 47 in the top portion 40 of housing 35. A slotted cover 48 is received within the warm mist discharge opening 47 and encloses the discharge end 67 of the vapor discharge tube 47, thereby permitting vapor to be discharged from the discharge end 67 of the vapor discharge tube 47 and out the top portion 41 of the housing 35.

With respect to the evaporative chamber 43, the evaporative chamber 43 within the housing 35 is positioned directly over the evaporative portion 50 of the tray 19. As illustrated in FIG. 9, the bottom portion 41 of the housing 35 beneath the evaporative chamber 43 is substantially open so that the upper evaporation portion 34 of the wick element 30 is received within the evaporative chamber 43 and is disposed adjacent and parallel to the inlet slots 42 formed in the rear wall 37.

Referring to FIGS. 9 and 10, a blower assembly 70 is positioned within the evaporative chamber 43 above the inlet slots 42 and wick element 30. Preferably, the blower assembly 70 is secured to the rear wall 37 of housing 35. The blower assembly 70 comprises a fan 71 driven by an electric motor 72. The fan 71 is enclosed within a shroud 73 having an inlet opening 74 and an exhaust opening 75. The blower exhaust opening 75 is positioned directly beneath the evaporative discharge opening 45 in the top portion 40 of the housing 35. A slotted cover 46 is received within the evaporative discharge opening 45 directly above the blower exhaust opening 75, thereby permitting cool mist vapor to be discharged from the opening 75 and out the top portion 41 of the housing 35.

In a preferred embodiment of the present invention, the housing 35 is retained in its proper position relative the base 14 and tray 19 by a locking assembly 79 comprising an elongated spring-biased latch member 80 slidably mounted within a channel member 81. Referring to FIG. 9, the locking assembly 79 is supported by and attached to an elevated column 82 projecting upwardly from the lower surface 17 of the base 14. Preferably, the column 82 is integrally formed with the base 14.

The housing 35 includes a depending skirt 83 extending downwardly from the bottom portion 41 of the front wall 36 and a locking tab 84 projecting outwardly from the depending skirt 83. As such, when the housing 35 is properly positioned on the base 14, an end 85 of the spring-biased latch member 80 lockingly engages the locking tab 84 to retain the housing 35 in its proper position. To remove the housing 35 from the base 14, the latch member 80 is moved (against the resistance of a spring) away from the front wall 36 of the housing 35, thereby disengaging the end 85 of the latch member 80 from the locking tab 84.

OPERATION

To prepare the humidifier 10 for use, the tank 12 is removed from the base 14 and may be carried by the upper or lower handle 87, 88 of the tank 12. The tank 12 is inverted, one of the two control valves 90 threadedly attached to the bottom of the tank 12 is removed by rotating the control valve 90 counter clockwise, and the tank 12 is filled with cool water through an opening 89 created by the removal of the control valve. The normally-closed control valve 90 is then reattached to the bottom of the tank 12 and the sealed tank 12 is again inverted and positioned on the base 14 so that each control valve 90 projects into a respective reservoir portion 51, 53 and rests upon a valve actuating stem 39*a*, 39*b* projecting upwardly from the corresponding reservoir portions 51, 53.

Operation of the sealed tank 12 and control valves 90 is conventional and a disclosure thereof appears, for example, in U.S. Pat. Nos. 5,034,162, 5,210,818 and 5,247,604. In general, engagement of the control valves on the actuator stems 39*a*, 39*b* moves the control valves 90 into an open position and water from the tank 12 flows through the opened control valves 90 and fills the respective evaporative and warm mist cavities 23, 24 to a desired level. As long as a supply of water exists in the sealed tank 12, the water volume in the respective cavities 23, 24 will be maintained at the desired level.

Prior to initiating operation of the humidifier 10, the wick element 30 is appropriately positioned within the evaporative portion 50 of tray 19. The housing 35 is then positioned on the base 14 above the evaporative portion 50 and boiler cavity 54 so that the upper evaporation portion 34 of the wick element 30 is properly positioned within the evaporative chamber 43 of housing 35. In this position, the upper evaporation portion 34 of the wick element 30 is disposed directly adjacent to and generally parallel with the inlet slots 42 formed in the rear wall 37 proximate the evaporative chamber 43 in housing 35. In addition, the lower supply portion 33 of the wick element 30 will be below the upper surface of the water volume contained in the evaporative portion 50 of tray 19. Capillary action causes liquid to flow through the absorbent capillary wick material 32 from the lower supply portion 33 submerged in the water contained in the evaporative portion 50 upwardly to the upper evaporation portion 34 disposed in proximity to the inlet slots 42.

Activation of the evaporative mode of the humidifier 10 is accomplished by moving an electrical switch 86 on the humidifier 10 to a first position. In this first position, the switch 86 closes and causes current to be provided to the motor 72 to produce rotation of the fan 71. The blades of the rotating fan 71 draw ambient air into the evaporative chamber 43 through inlet slots 42 formed in the rear wall 37 of housing 35. The air drawn into the evaporative chamber 43 through the inlet slots 42 passes through the upper evaporative portion 34 of wick element 30 and produces evaporation of the liquid content in the wick element 30. The resultant vapor is entrained in the air flow for discharge into the surrounding environment through the evaporative discharge opening 45 and slotted cover 46.

Activation of the warm mist mode of the humidifier 10 is accomplished by moving the electrical switch 86 on the humidifier 10 to a second position. In this second position, the switch 86 closes and causes current to be provided to the heater coil 60. Upon energization of the heater coil 60, water within the boiler cavity 54 which has flowed through the liquid supply channel 55 from the reservoir portion 53 is heated to a boiling point causing evaporation and resultant dispersion thereof. Because of the restricted and isolated water volume provided by the boiler cavity 54, heater coil 60 and shroud 61, an extremely efficient evaporation process is obtained.

The vapor produced rises through the opening 63 in the heater coil shroud 61 and into the warm mist chamber 44 of housing 35. The vapor continues to rise through the vapor passageway 65 of the vapor discharge tube 64 and is discharged from the humidifier 10 into the surrounding environment through the warm mist discharge opening 47 and slotted cover 48. Enhancement of the vapor dispersion and discharge is obtained by drawing ambient air into the warm mist chamber 44 through the inlet slots 42 formed in the rear wall 37 of housing 35. The ambient air drawn into the warm mist chamber 44 draws vapor formed in the boiler cavity 54 through the vapor passageway 65 for discharge into the surrounding environment through the warm mist discharge opening 47 and slotted cover 48.

In addition to operating the humidifier 10 in the above-described evaporative or warm mist modes, the humidifier 10 may also be operated in a combined evaporative/warm mist mode where the above-described evaporative and warm mist modes operate simultaneously. Activation of the combined evaporative/warm mist mode of the humidifier 10 is accomplished by moving the electrical switch 86 on the humidifier 10 to a third position. In this third position, the switch 86 closes and causes current to be provided to both the blower motor 72 and the heater coil 60, thereby causing the humidifier to operate in the evaporative and warm mist modes simultaneously. In the combined evaporative/warm mist mode, both the evaporative and warm mist modes operate in the manner described above.

Although illustrative preferred embodiments have been described herein in detail, it should be noted and will be appreciated by those skilled in the art that numerous variations may be made within the scope of this invention without departing from the principle of this invention and without sacrificing its chief advantages. The terms and expressions have been used herein as terms of description and not terms of limitation. There is no intention to use the terms or expressions to exclude any equivalents of features shown and described or portions thereof and this invention should be defined in accordance with the claims which follow.

We claim:

1. A combination evaporative/warm mist humidifier capable of selectively operating in an evaporative mode, a warm mist mode, and/or a combined evaporative/warm mist mode, comprising:

(a) a base;

(b) an evaporative cavity disposed within said base;

(c) a warm mist cavity disposed within said base;

(d) a wick element comprising a lower supply portion disposed within said evaporative cavity and an upper evaporative portion disposed thereabove, said wick element adapted to provide liquid flow by capillary action from said lower supply portion to said upper evaporative portion;

(e) a housing removably mounted on said base, said housing comprising an evaporative chamber and a warm mist chamber, each chamber comprising an inlet opening, a discharge opening, and a fluid passageway therebetween, said evaporative chamber disposed above said evaporative cavity and adapted to receive said upper evaporative portion of said wick element, and said warm mist chamber disposed above said warm mist cavity;

(f) a selectively operable heating element disposed within said warm mist cavity for inducing evaporation of liquid contained therein, said warm mist chamber adapted to receive said evaporated liquid vapor through said inlet opening and to discharge said vapor through said discharge opening; and (g) a selectively operable blower assembly mounted in said evaporative chamber.

2. The combination evaporative/warm mist humidifier according to claim 1, wherein said housing is removably secured to said base by a locking assembly.

3. The combination evaporative/warm mist humidifier according to claim 2, wherein said locking assembly comprises a spring-biased latch member mounted to said base for locking engagement with a locking tab formed on an outer surface of said housing.

4. The combination evaporative/warm mist humidifier according to claim 1, wherein said blower assembly comprises a fan driven by an electric motor.

5. The combination evaporative/warm mist humidifier according to claim 4, further comprising an electrical switch adapted to selectively energize said electric motor driving said fan without energizing said heating element in order to operate said humidifier in said evaporative mode, to selectively energize said heating element without energizing said electric motor in order to operate said humidifier in said warm mist mode, and to selectively energize both said heating element and said electric motor simultaneously in order to operate said humidifier in a combined evaporative/warm mist mode.

6. The combination evaporative/warm mist humidifier according to claim 1, wherein the housing further comprises at least one air inlet for introducing ambient air from the environment into the evaporative and warm mist chambers.

7. The combination evaporative/warm mist humidifier according to claim 6, wherein said upper evaporative portion of said wick element is disposed adjacent to and generally parallel to at least a portion of said air inlet within said evaporative chamber, and wherein said blower assembly is adapted to draw ambient air through said air inlet and through said upper evaporative portion of said wick element in order to induce evaporation of liquid therein.

8. The combination evaporative/warm mist humidifier according to claim 7, further comprising a liquid supply tank removably mounted on said base, said liquid supply tank having a discharge opening in communication with said evaporative and warm mist cavities, said tank further comprising a valve adapted to provide a controlled discharge of liquid from said tank through said discharge opening in order to maintain a given amount of liquid in said evaporative and warm mist cavities.

9. The combination evaporative/warm mist humidifier according to claim 8, wherein said liquid supply tank comprises first and second discharge openings, and first and second valves associated with the first and second discharge openings respectively, said first discharge opening communicating with said evaporative cavity and said first valve adapted to provide a controlled discharge of liquid from said tank through said first discharge opening in order to maintain a given amount of liquid in said evaporative cavity, and said second discharge opening communicating with said warm mist cavity and said second valve adapted to provide a controlled discharge of liquid from said tank through said second discharge opening in order to maintain a given amount of liquid in said warm mist cavity.

10. The combination evaporative/warm mist humidifier according to claim 9, wherein said liquid supply tank comprises a top and a bottom surface, said first and second discharge openings being formed in said bottom surface, and said liquid supply tank further comprising a first handle mounted on said top surface and a second handle mounted on said bottom surface of said liquid supply tank.

11. The combination evaporative/warm mist humidifier according to claim 9, wherein said base comprises a lower surface and a peripheral wall, said peripheral wall extending upwardly from said lower surface and extending continuously along the perimeter of the base, and wherein said lower surface and said peripheral wall define a recess within said base above said lower surface.

12. The combination evaporative/warm mist humidifier according to claim 11, further comprising a tray member defining the evaporation and warm mist cavities, said tray member being removably disposed within said recess in said base and supported by said lower surface of said base.

13. The combination evaporative/warm mist humidifier according to claim 12, wherein said evaporative and warm mist cavities are independent from one another.

14. The combination evaporative/warm mist humidifier according to claim 13, wherein said evaporative and warm mist cavities are separated by an dividing wall formed within said tray member.

15. The combination evaporative/warm mist humidifier according to claim 14, wherein said evaporative cavity comprises an evaporative portion and a first reservoir portion in fluid communication with one another, said lower supply portion of said wick element being located within said evaporation portion and said first valve associated with said first discharge opening of said liquid supply tank projecting into said first reservoir portion.

16. The combination evaporative/warm mist humidifier according to claim 15, wherein a first valve actuating stem projecting upwardly from said first reservoir portion engages said first valve and causes said first valve to move to an open position.

17. The combination evaporative/warm mist humidifier according to claim 14, wherein said warm mist cavity comprises a boiler cavity and a second reservoir portion in fluid communication with one another, said heating element disposed within said boiler cavity for inducing evaporation of liquid contained therein and said second valve associated with said second discharge opening of said liquid supply tank projecting into said second reservoir portion.

18. The combination evaporative/warm mist humidifier according to claim 17, wherein said warm mist cavity further comprises a liquid supply channel fluidly connecting said second reservoir portion to said boiler cavity.

19. The combination evaporative/warm mist humidifier according to claim 18, wherein a second valve actuating stem projecting upwardly from said second reservoir portion engages said second valve and causes said second valve to move to an open position.

20. The combination evaporative/warm mist humidifier according to claim 18, wherein said heater coil is attached to said housing beneath said inlet orifice of said warm mist chamber.

21. The combination evaporative/warm mist humidifier according to claim 20, further comprising a shroud attached to said housing at the inlet orifice of said warm mist chamber and partially enclosing said heater coil, said shroud having an opening above said heater coil in communication with said warm mist chamber and adapted to allow evaporated liquid vapor rising from said boiler cavity to pass through said shroud opening into said warm mist chamber.

22. The combination evaporative/warm mist humidifier according to claim 21, wherein an elongated vapor discharge tube is positioned within said warm mist chamber directly above said shroud opening, said vapor discharge tube comprising a vapor passageway fluidly connecting an inlet opening to a discharge opening, wherein said vapor discharge tube is adapted to allow said evaporated liquid vapor passing through said shroud opening to be drawn into said tube inlet opening, pass through said vapor passageway, and be discharged from said tube through said tube discharge opening.

23. The combination evaporative/warm mist humidifier according to claim 22, wherein said inlet opening in said vapor discharge tube is disposed adjacent to said air inlet within said warm mist chamber.

24. A combination evaporative/warm mist humidifier capable of selectively operating in an evaporative mode, a warm mist mode, and/or a combined evaporative/warm mist mode, comprising:

(a) a base;

(b) an evaporative cavity disposed within said base;

(c) a warm mist cavity disposed within said base;

(d) a wick element comprising a lower supply portion disposed within said evaporative cavity and an upper evaporative portion disposed thereabove, said wick element adapted to provide liquid flow by capillary action from said lower supply portion to said upper evaporative portion;

(e) a housing removably mounted on said base, said housing comprising an evaporative chamber and a warm mist chamber, each chamber comprising an inlet opening, a discharge opening, and a fluid passageway therebetween, said evaporative chamber disposed above said evaporative cavity and adapted to receive said upper evaporative portion of said wick element, and said warm mist chamber disposed above said warm mist cavity;

(f) a selectively operable electric heating element disposed within said warm mist cavity for inducing evaporation of liquid contained therein, said inlet opening in said warm mist chamber adapted to receive said evaporated liquid vapor and said warm mist chamber adapted to discharge said vapor through said discharge opening;

(g) a selectively operable blower assembly mounted in said evaporative chamber, said blower assembly comprising a fan driven by an electric motor; and (h) an electrical switch adapted to selectively energize said electric motor driving said fan without energizing said heating element in order to operate said humidifier in said evaporative mode, to selectively energize said heating element without energizing said electric motor in order to operate said humidifier in said warm mist mode, and to selectively and simultaneously energize both said heating element and said electric motor in order to operate said humidifier in a combined evaporative/warm mist mode.

25. A combination evaporative/warm mist humidifier capable of selectively operating in an evaporative mode, a warm mist mode, and/or a combined evaporative/warm mist mode, comprising:

(a) means for retaining a liquid volume;

(b) means for inducing evaporation of said liquid volume in an evaporative mode, said evaporative mode means comprising wick means having a first portion disposed within said retaining means and adapted to provide by capillary action a liquid flow from said first portion to a second portion of said wick means disposed outside said retaining means; said evaporative means further comprising means for inducing air flow through said second portion to evaporate liquid content within said second portion and to discharge said evaporated liquid content from said humidifier;

(c) means for inducing evaporation of said liquid volume in a warm mist mode, said warm mist means comprising heating means disposed within said retaining means for inducing evaporation of liquid contained therein; and (d) means for selectively activating said evaporative mode means and said warm mist means so that said humidifier may be operated in an evaporative mode alone, a warm mist mode alone, or a combined evaporative/warm mist mode.

* * * * *